United States Patent [19]

Hayashi

[11] Patent Number: 4,604,973

[45] Date of Patent: Aug. 12, 1986

[54] EVAPORATIVE COOLED ENGINE HAVING MANUAL CONTROL FOR SERVICE FACILITATION

[75] Inventor: Yoshimasa Hayashi, Kamakura, Japan

[73] Assignee: Nissan Motor Co., Ltd., Yokohama, Japan

[21] Appl. No.: 739,288

[22] Filed: May 30, 1985

[30] Foreign Application Priority Data

Jun. 18, 1984 [JP] Japan ..... 50-124777

[51] Int. Cl.[4] ..... F01P 9/02

[52] U.S. Cl. ..... 123/41.21; 123/41.27; 123/41.44

[58] Field of Search ..... 123/41.08, 41.2–41.27, 123/41.44

[56] References Cited

U.S. PATENT DOCUMENTS

| | | | |
|---|---|---|---|
| 1,687,679 | 10/1928 | Mallory | 123/41.27 |
| 1,787,562 | 1/1931 | Barlow | 123/41.44 |
| 4,367,699 | 1/1983 | Evans | 123/41.23 |
| 4,387,670 | 6/1983 | Robin et al. | 123/41.08 |
| 4,425,878 | 1/1984 | Samuel | 123/41.08 |
| 4,549,505 | 10/1985 | Hirano | 123/41.08 |

*Primary Examiner*—William A. Cuchlinski, Jr.

*Attorney, Agent, or Firm*—Schwartz, Jeffery, Schwaab, Mack, Blumenthal & Evans

[57] ABSTRACT

In order to facilitate the servicing of an engine cooling system in which the coolant is permitted to boil and the vapor used a vehicle for removing heat from the engine, the system is arranged so that it may be manually conditioned so that a coolant return pump which normally returns liquid coolant from a radiator in which the gaseous coolant is condensed to its liquid form, to the coolant jacket of the system, inducts coolant from a reservoir and pumps same into the cooling circuit in a manner that the coolant introduced into the system firstly flows through the radiator (from bottom to top) in manner which flushes out any bubbles of non-condensible matter or the like which may be adhering to the inner walls of the radiator tubing, before flowing into the remaining sections of the system which define a cooling circuit which is normally placed in a hermetically sealed condition during engine operation.

5 Claims, 7 Drawing Figures

EVAPORATIVE COOLED ENGINE HAVING MANUAL CONTROL FOR SERVICE FACILITATION

BACKGROUND OF THE INVENTION

1. Field of the Invention

The present invention relates generally to an evaporative cooled engine and more specifically to a evaporative cooled engine which is equipped with an arrangement which facilitates the servicing of the system.

2. Description of the Prior Art

In currently used "water cooled" internal combustion engines such as shown in FIG. 1 of the drawings, the engine coolant (liquid) is forcefully circulated by a water pump, through a circuit including the engine coolant jacket and an air cooled radiator. This type of system encounters the drawback that a large volume of water is required to be circulated between the radiator and the coolant jacket in order to remove the required amount of heat.

Further, due to the large mass of water inherently required. the warm-up characterictics of the engine are undesirably sluggish. For example, if the temperature difference between the inlet and discharge ports of the coolant jacket is 4° C., the amount of heat which 1 Kg of water may effectively remove from the engine under such conditions is 4 Kcal. Accordingly, in the case of an engine having 1800 cc displacement (by way of example) is operated at full throttle, the cooling system is required to remove approximately 4000 Kcal/h. In order to achieve this a flow rate of 167 Liter/min (viz., $4000-60\times1.5$) must be produced by the water pump. This of course undesirably consumes a number of otherwise useful horsepower.

FIG. 2 shows an arrangement disclosed in Japanese Patent Application Second Provisional Publication No. Sho 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement has suffered from the drawbacks that the radiator, depending on its position with respect to the engine proper tends to be at least partially filled with liquid coolant. This greatly reduces the surface area via which the gaseous coolant (for example steam) can effectively release its latent heat of vaporization and accordingly condense and thus has lacked any notable improvement in cooling efficiency.

Further, with this system in order to maintain the pressure within the coolant jacket and radiator at atmospheric level, a gas permeable water shedding filter 5 is arranged as shown, to permit the entry of air into and out of the system. However, this filter permits gaseous coolant to gradually escape from the system, inducing the need for frequent topping up of the coolant level.

A futher problem with this arrangement has come in that some of the air, which is sucked into the cooling system as the engine cools, tends to dissolve in the water, whereby upon start up of the engine, the dissolved air tends to form small bubbles in the radiator which adhere to the walls thereof forming an insulating layer. The undisolved air tends to collect in the upper section of the radiator and inhibit the convection-like circulation of the vapor from the cylinder block to the radiator. This of course further deteriorates the performance of the device.

European Patent Application Provisional Publication No. 0 059 423 published on Sept. 8, 1982 discloses another arrangement wherein, liquid coolant in the coolant jacket of the engine, is not circulated therein and permitted to absorb heat to the point of boiling. The gaseous coolant thus generated is adiabatically compressed in a compressor so as to raise the temperature and pressure thereof and introduced into a heat exchanger. After condensing, the coolant is temporarily stored in a reservoir and recycled back into the coolant jacket via a flow control valve.

This arrangement has suffered from the drawback in that air tends to leak into the system upon cooling thereof. This air tends to be forced by the compressor along with the gaseous coolant into the radiator. Due to the difference in specific gravity, the air tends to rise in the hot environment while the coolant which has condensed moves downwardly. The air, due to this inherent tendency to rise, forms large bubbles of air which cause a kind of "embolism" in the radiator and badly impair the heat exchange ability thereof. U.S. Pat. No. 4,367,699 issued on Jan. 11, 1983 in the name of Evans (se FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the "dry" gaseous coolant (steam for example) is condensed in a fan cooled radiator 8. The temperature of the radiator is controlled by selective energizations of the fan 9 to maintain a rate of condensation therein sufficient to maintain a liquid seal at the bottom of the device. Condensate discharged from the radiator via the above mentioned liquid seal is collected in a small reservoir-like arrangement 10 and pumped back up to the separation tank via a small pump 11.

This arrangement, while providing an arrangement via which air can be initially purged from the system tends to, due to the nature of the arrangement which permits said initial non-condensible matter to be forced out of the system, suffers from rapid loss of coolant when operated at relatively high altitudes.

Further, once the engine cools air is relatively freely admitted back into the system. The provision of the separation tank 6 also renders engine layout difficult.

Japanese Patent Application First Provisional Publication No. Sho. 56-32026 (see FIG. 4 of the drawings) discloses an arrangement wherein the structure defining the cylinder head and cylinder liners are covered in a porous layer of ceramic material 12 and coolant sprayed into the cylinder block from shower-like arrangements 13 located above the cylinder heads 14. The interior of the coolant jacket defined within the engine proper is essentially filled with gaseous coolant during engine operation during which liquid coolant sprayed onto the ceramic layers 12. However, this arrangement has proved totally unsatisfactory in that upon boiling of the liquid coolant absorbed into the ceramic layers the vapor produced within the layers inhibits the penetration of fresh liquid coolant into the same whereby rapid overheat and thermal damage of the engine soon results.

Further, this arrangement is plagued with air contamination and blockages in the radiator similar to the compressor equipped arrangement discussed above.

U.S. Pat. No. 1,787,562 issued on Jan. 6, 1931 in the name of Barlow, discloses a vapor cooled engine wherein a level sensor is disposed in the coolant jacket and arranged to control a pump which recycles condensed coolant from a small reservoir located at the base of the radiator in which coolant vapor is condensed, back to the coolant jacket. However, in this system the interior of the system is vented to the atmosphere via a small valve disposed atop of the reservoir. Accordingly, with this system although some provision is made for displacing the air which inevitably enters the cooling circuit of this arrangement, this very provision prevents control of the boiling point of the coolant via varying the pressure within the system. Further, the low level location of the valve inhibits complete purging of the air which exters the system during non-use.

In summary, although the basic concepts of open and closed "evaporative cooling" systems wherein the coolant is boiled to make use of the latent heat of evaporation thereof and condensed in a suitable heat exchanger, is known, the lack of a control system which is both sufficiently simple as to allow practical use and which overcomes the various problems plauging the prior art is wanting.

SUMMARY OF THE PRESENT INVENTION

It is an object of the present invention to provide an evaporative cooled engine which in addition to being able to perform in a manner which enables the temperature of the engine to be maintained at that optimal for the given set of operational conditions during normal vehicle operation also enables easy filling and/or servicing.

In brief, the above object is achieved by an arrangement wherein in order to facilitate the servicing of an engine cooling system in which the coolant is permitted to boil and the vapor used a vehicle for removing heat from the engine, the system is arranged so that it may be manually conditioned so that a coolant return pump which normally returns liquid coolant from a radiator in which the gaseous coolant is condensed to its liquid form, to the coolant jacket of the system, inducts coolant from a reservoir and pumps same into the cooling circuit in a manner that the coolant introduced into the system firstly flows through the radiator (from bottom to top) in manner which flushes out any bubbles of non-condensible matter or the like which may be adhering to the inner walls of the radiator tubing, before flowing into the remaining sections of the system which define a cooling circuit which is normally placed in a hermetically sealed condition during engine operation. The system includes an automatic non-condensible matter purge function which displaces air and the like each time the engine is subject to a "cold" start in order to maintain the system essentially free of contaminating air and the like between services.

More specifically, the present invention takes the form of an internal combustion engine which includes a structure subject to high heat flux; and a cooling system comprising: (a) a cooling circuit which includes: a coolant jacket formed about the structure subject to high heat flux and into which coolant is introduced in liquid form, permitted to boil and discharged in gaseous form, a radiator exposed to a cooling medium which can remove heat from the radiator, a vapor transfer conduit leading from the coolant jacket to the radiator for transferring gaseous coolant from the coolant jacket to the radiator for condensation therein, and means for returning coolant condensed to its liquid form in the radiator to the coolant jacket in a manner to maintain the structure immersed in a predetermined depth of liquid coolant, the coolant returning means taking the form of: a coolant return conduit which leads from a lower portion of the radiator to the coolant jacket; a pump disposed in the coolant return conduit, and a first level sensor disposed in the coolant jacket, the first level sensor being arranged to control the pump in a manner to maintain the structure immersed in the predetermined depth of liquid coolant, and means defining a port in an upper portion of the cooling circuit, the port being closed by a manually removable member; (b) a reservoir containing liquid coolant; (c) valve and conduit means for controlling fluid communication between the reservoir and the cooling circuit, the valve and conduit means including: a first valve disposed in the coolant return conduit between the radiator and the pump, and a first conduit which leads from the reservoir to the first valve, the first valve having a first state wherein communication between the pump and the radiator is established and a second state wherein communication between the pump and the reservoir is established; (d) a two position valve disposed in the coolant return conduit at a position between the pump and the coolant jacket; and (e) a by-pass conduit leading from the coolant return conduit to the lower portion of the radiator, the two position valve having a first position wherein the pump is communicated with the coolant jacket and a second position wherein the pump is communicated with the lower portion of the radiator.

DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Before proceeding with the description of the actual embodiment of the present invention, it is deemed advantageous to firstly discuss the concepts on which the present invention is based.

Figure 1:
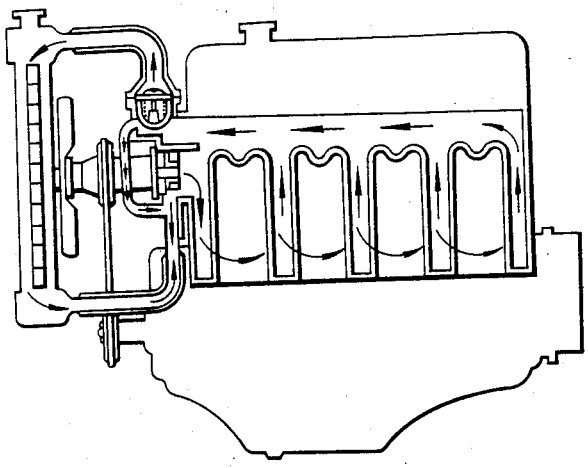
FIG.1 (PRIOR ART)
FIG. 1 is a partially sectioned elevation showing a currently used conventional water circulation type system discussed in the opening paragraphs of the instant disclosure.
Figure 2:
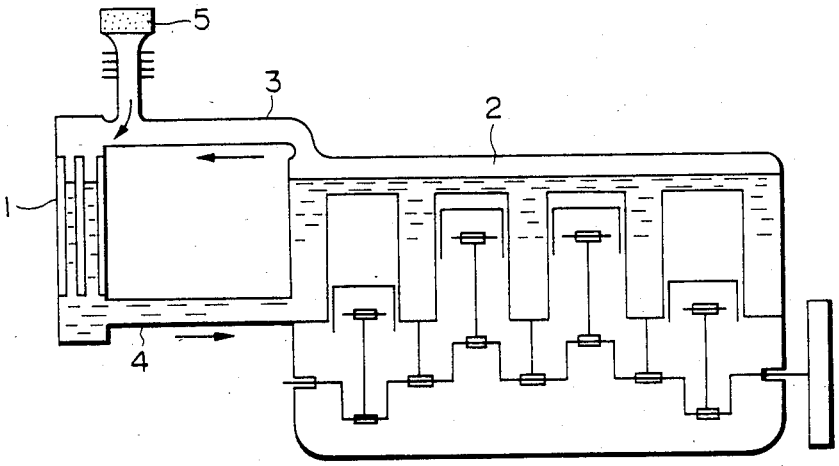
FIG.2 (PRIOR ART)
FIG. 2 is a schematic side sectional elevation of a prior art arrangement also discussed briefly in the earlier part of the specification.
Figure 3:
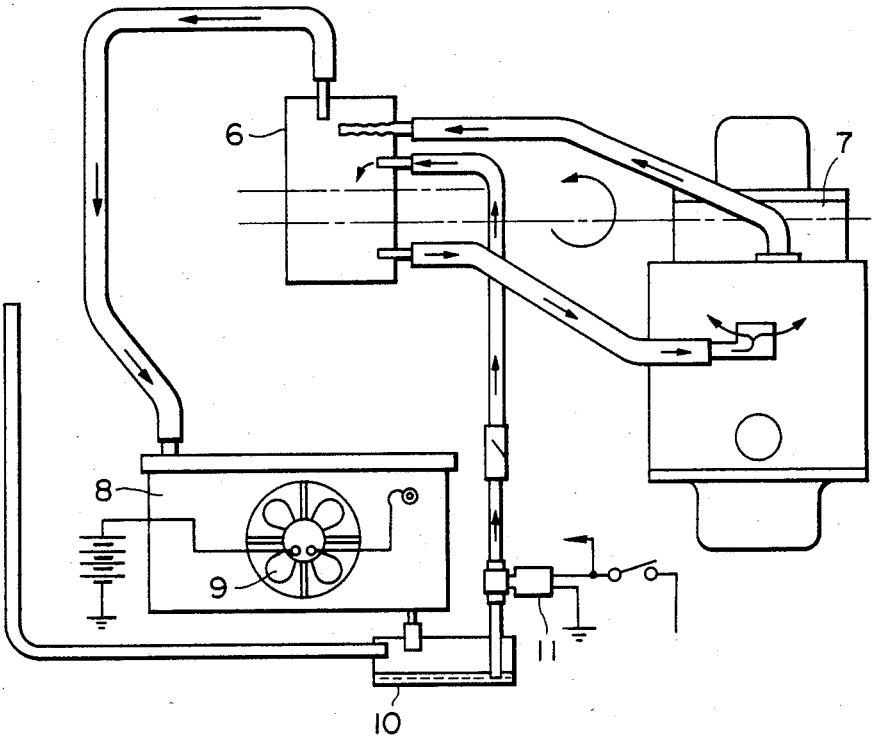
FIG.3 (PRIOR ART)
FIG. 3 shows in schematic layout form, another of the prior art arrangements previously discussed.
Figure 4:
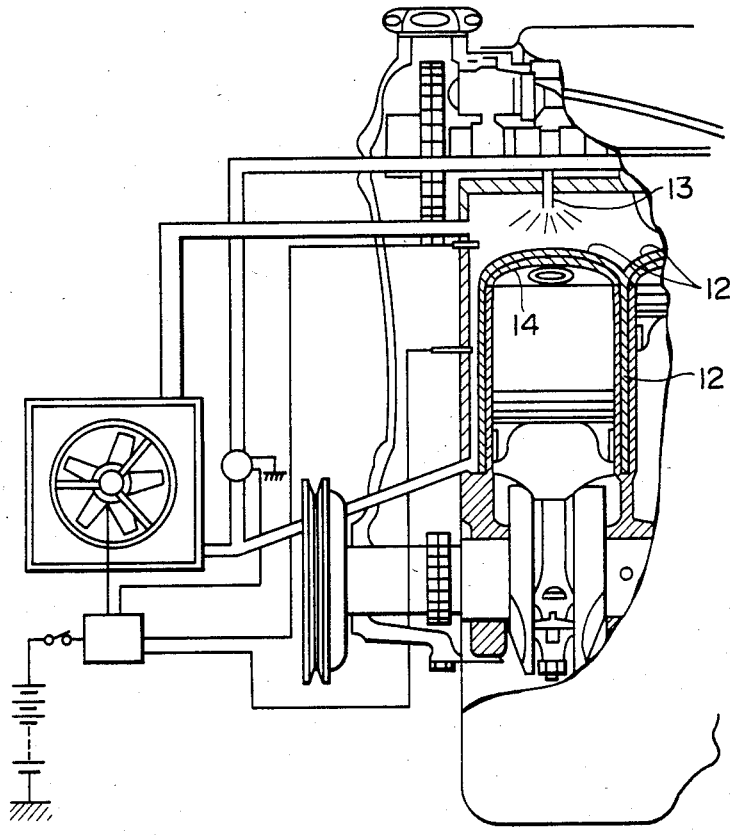
FIG.4 (PRIOR ART)
FIG. 4 shows in partial section yet another of the previously discussed prior art arrangements.
Figure 5:
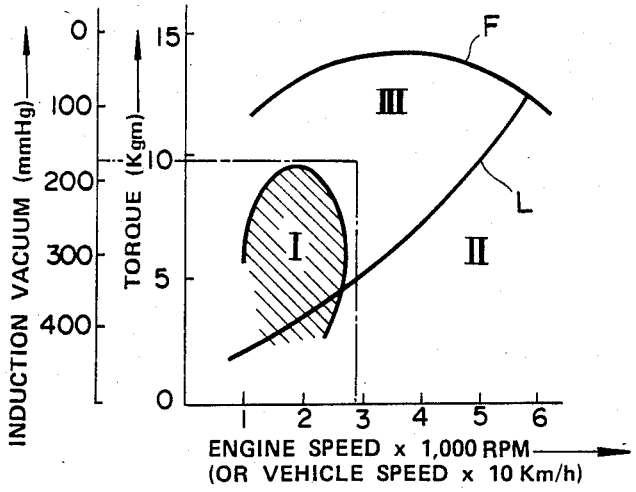
FIG. 5 is a graph showing in terms of engine torque and engine/vehicle speed the various load zones encountered by an automotive vehicle.

FIG. 5 graphically shows, in terms of engine torque and engine speed, the varous load "zones" which are encountered by an automotive vehicle engine. In this graph, the curve F denotes full throttle torque characteristics, trace L denotes the resistance encountered when a vehicle is running on a level surface, and zones I, II and III denote respectively what shall be referred to as "urban cruising", "high speed cruising" and "high load operation" (such as hillclimbing, towing etc.).

A suitable coolant temperature for zone I is in the order of 120° C. (for example) while as low as 90° C. (for example) for zones II and III. If desired it is possible to induce the coolant to boil at approximately 100° C. in zone II if so desired.

The high temperature during "urban cruising" promotes improved thermal efficiency and fuel economy while the lower temperatures promote improved charging efficiency while simultaneously removing sufficient heat from the engine and associated structure to obviate engine knocking and/or possibility of engine damage in the other zones.

Figure 6:
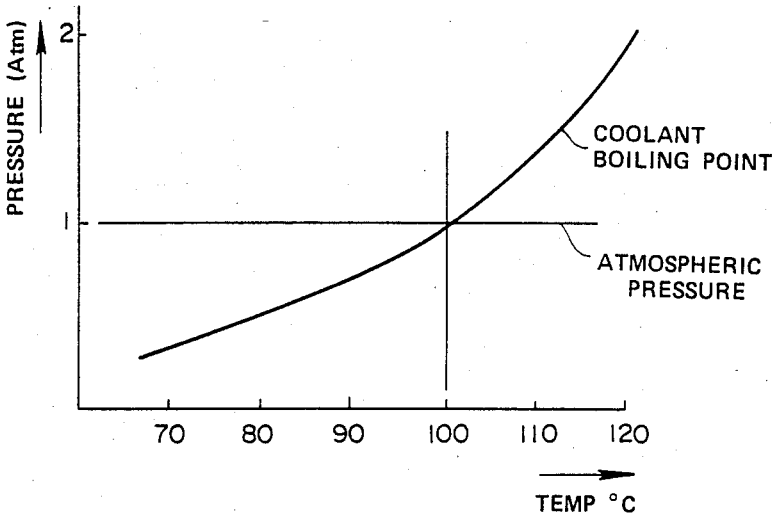
FIG. 6 is a graph showing in terms of pressure and temperature, the change which occurs in the coolant boiling point with change in pressure.

With the present invention, in order to control the temperature of the engine, advantage is taken of the fact that with a cooling system wherein the coolant is boiled and the vapor used a heat transfer medium, boiling is most vigorous in zones of high heat flux, whereby the temperature of engine structure subject to high heat flux is maintained essentially equal to that of structure subject to less intensive heating whereat boiling is less vigorous and less heat removed; the amount of coolant actually circulated between the coolant jacket and the radiator is very small; the amount of heat removed from the engine per unit volume of coolant is very high; and upon boiling, the pressure prevailing within the coolant jacket and consequently the boiling point of the coolant rises if the system employed is closed. Thus, by circulating a restriced amount of cooling air over the radiator, it is possible reduce the rate of condensation therein and cause the pressure within the cooling system to rise above atmospheric and thus induce the situation, as shown in FIG. 6, wherein the engine coolant boils at temperatures above 100° C.—for example at approximately 110° C.

On the other hand, during high speed cruising, it is further possible by increasing the flow of cooling air passing over the radiator (for example by energizing a cooling fan as required to supplement the natural draft of air which occurs under such conditions) to increase the rate of condensation within the radiator to a level which reduces the pressure prevailing in the cooling system below atmospheric and thus induce the situation wherein the coolant boils at temperatures below 100° C.—for example at approximately 90° C.

Figure 7:
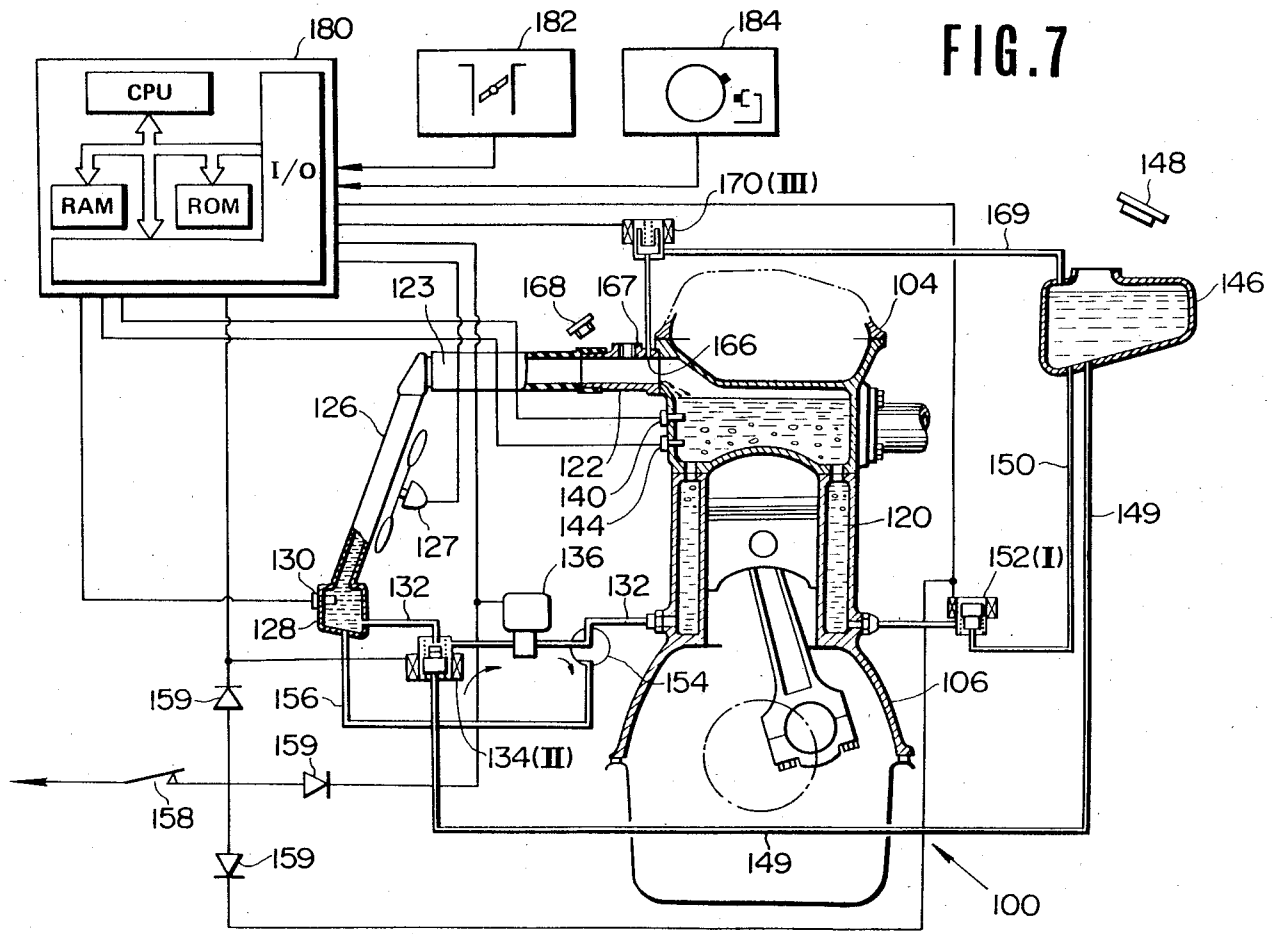
FIG. 7 is a schematic partially sectioned view showing a "evaporative" cooled type engine system equipped with a first embodiment of the present invention.

FIG. 7 shows an engine system incorporating a first embodiment of the present invention. In this arrangement, an internal combustion engine 100 includes a cylinder block 106 on which a cylinder head 104 is detachably secured. The cylinder head 104 and cylinder block 106 include suitable cavities which define a coolant jacket 120 about the heated portions of the cylinder head and block.

Fluidly communicating with a vapor discharge port of the cylinder head 104 via a vapor manifold 122 and vapor transfer conduit 123, is a radiator or heat exchanger 126. It should be noted that the interior of this radiator 126 is usually maintained essentially empty of liquid coolant during normal engine operation so as to maximize the surface area available for condensing coolant vapor (via heat exchange with the ambient atmosphere) and that the cooling system as a whole (viz., the cooling circuit encompassed by the coolant jacket, radiator and conduiting interconnecting same) is hermetically closed when the engine is warmed-up and running. However, it is within the scope of the present invention to partialy fill and/or control the amount of coolant within the radiator 126 in order to appropriately control the temperature of the coolant if the external ambient conditions so demand. These features will become clearer as the description proceeds.

If deemed advantageous a mesh screen or like separator (not shown) can be disposed in the vapor discharge port 121 of the cylinder head so as to minimize the transfer of liquid coolant which tends to froth during boiling, to the radiator 126.

Alternatively, cylinder head and vapor manifold arrangements such as disclosed in U.S. Pat. No. 4,499,866 issued on Feb. 19, 1985 in the name of Hirano and U.S. patent application Ser. No. 624,369 filed in June 25, 1984 in the name of Hirano et al, can be employed if desired.

Located suitably adjacent the radiator 126 is a electrically driven fan 127. Defined at the bottom of the radiator 126 is a small collection reservoir or lower tank 128 as it will be referred to hereinafter.

Disposed in the lower tank 128 is a level sensor 130 which is adapted to output a signal indicative of the level of liquid coolant in the lower tank 128 falling therebelow. Viz., being lower than a level which is beneath the lower ends of the relatively small diameter tubing which constitute heat exchanging portion the radiator.

Leading from the lower tank 28 to the cylinder block 120 is a return conduit 132. As shown, a "three-way" type electromagnetic valve 134 and a relatively small capacity return pump 136 are disposed in this conduit. The valve 134 is located upstream of the pump 136. The return conduit 132 is arranged to communicate with the lowermost portion of the coolant jacket 120.

In order to sense the level of coolant in the coolant jacket and appropriately control the operation of the pump 136, a level sensor 140 is disposed as shown. It will be noted that this sensor is arranged at a level higher than that of the combustion chambers, exhaust ports and valves (i.e. structure subject to high heat flux) so as to enable same to be securely immersed in coolant and thus attenuate any engine knocking and the like which might otherwise occur due to the formation of localized zones of abnormally high temperature or "hot spots".

In this embodiment the level sensor 140 is arranged to output a signal indicative of the coolant having fallen below a first predetermined level and maintain said output until the coolant has risen to a second level which is higher than the first. This hysteresis action obviates rapid ON/OFF cycling of pump 136.

It will also be noted that the level sensor 140 is located at a level lower than the upper section or roof of the structure of the cylinder head which defines the coolant jacket therein, so as to define a coolant vapor collection space above the liquid coolant.

Located below the level sensor 140 so as to be immersed in the liquid coolant is a temperature sensor 144.

A coolant reservoir 146 is located beside the engine proper as shown. An air permeable cap 148 is used to close the reservoir 146 in a manner that atmospheric pressure continuously prevails therein.

The reservoir 146 fluidly communicates with the "three-way" valve 134 via a supply conduit 149 and with the engine coolant jacket 120 via a full/discharge conduit 150 and an ON/OFF type electromagnetic valve 152. The three-way valve 134 is arranged to establish fluid communication between the lower tank 128 and the coolant jacket 120 via a full/discharge conduit 150 and an ON/OFF type electromagnetic valve 152. The three-way valve 134 is arranged to establish fluid communication between the lower tank 128 and the coolant jacket 120 when de-energized while establish fluid communication between the coolant jacket 120 and the reservoir 146 when energized. Valve 152 is arranged to be closed when energized.

Disposed in conduit 132 between the pump 136 and the coolant jacket 120 is a manually operable valve 154. Leading from this valve to the lower tank 128 is a bypass conduit 156.

During normal operation valve 154 is set so that communication between the pump and the coolant jacket is established. However, during initial filling of the system and/or during routine service of the same, valve 154 may be set to establish communication between the pump and the lower tank via conduit 156.

A manually operable switch 158 is operatively connected with the motor of the pump 136 and valves 134 and 152 via diodes 159 as shown.

The vapor manifold 122 is formed with a "purge" port 166 and a riser like portion 167 which is hermetically closed by a cap 168. The purge port 166, as shown, communicates with the reservoir 164 via a overflow conduit 169. A normally closed electromagnetic valve 170 is disposed in the overflow conduit 169. This valve is arranged to be open only when energized.

The above mentioned level sensors 130 & 140 may be of any suitable type such as float/reed switch types.

As shown, the outputs of the level sensors 130 & 140 and temperature sensor 144 are fed to a control circuit 180. In this embodiment the control circuit 180 includes therein a microprocessor including input and output interfaces I/O a CPU, a RAM and a ROM.

Suitable control programs are set in the ROM and are used to control the operation of the valves 134, 152 & 170, pump 136 and fan 127 in response to the various data supplied thereto. For further disclosure relating to circuitry via which the the above mentioned valves, pump and fan can be controlled, reference may be had to copending U.S. patent application Ser. No. 676,937 filed on Nov. 30, 1984 in the name of Hirano.

In order that the temperature of the coolant be appropriately controlled in response to changes in engine load and speed, a load sensor 182 and an engine speed sensor 184 are arranged to supply data signals to control circuit 180. The load sensor may take the form of a throttle position switch which is tiggered upon the engine throttle valve being opened beyond a predetermined degree. Alternatively the output of an air flow meter or an induction vacuum sensor may be used. The engine speed signal may be derived from the engine distributor, a crankshaft rotational speed sensor or the like.

It is within the scope of the present invention to arrange for a look-up table of the nature of that shown in FIG. 5 to be provided in the ROM of the microprocessor, or alternatively programs may be suitably devised to calculate the desired load/engine speed responsive temperature control in response to the varous data inputs.

With this arrangement when the engine is not running, as is usually the case when the system is initially being filled with coolant and or being serviced,, manual closure of the switch 158 supplies electrical energy to the above mentioned motor 136 and valves 134 & 152. Under these conditions valves 170 (III) and 152 (I) will be closed while valve 134 (11) will be conditioned to establish fluid communication between the pump 136 and the reservoir 146 (previously filled with an adequate amount of coolant).

If, at this time valve 154 is set so as to communicate the output of the pump 136 with the lower tank, coolant will be forced via energization of the pump 136 into the cooing circuit (viz., the coolant jacket 120, the radiator 126, the vapor transfer conduit 123 and the coolant return conduit 132) in a manner to fill same. Accordingly, by removing filler cap 168 and closing the switch 158 the cooling circuit can be readily filled to the brim with coolant the cap 168 replaced. It will be noted that as the fresh coolant is introduced into the cooling circuit via tank 128 any bubbles or the like non-condensible matter that may be adhering to the inner surfaces of the radiator conduiting, will be flushed upwardly through the radiator 126 toward the riser portion 167 whereat it is readily discharged from the system.

However, even when the system is completely filled with coolant (for example de-aerated water or a mixture of de-aerated water and antifreeze or the like) in a manner as described hereinabove and the cap 168 securely set in place to seal the system in a state essentially free from contaminating air etc.; over a period of time, non-condensible matter will find its way into the system. For example, the water (coolant) in the reservoir 146 will tend to absorb atmospheric air and each time the system is filled with coolant (explanation given in detail later) a little non-condensible matter will tend to find its way into the system. Further, during given modes of engine operation, negative pressures develop and although the system is operating in a sealed or closed mode at the time, air, little by little, tends to lead into the system via the gasketing and the like defined between the cylinder head and cylinder block and between the seals defined between conduiting and associated elements of the system.

Accordingly, to ensure that the system remains free of contaminating air between services, each time the engine is started and the engine temperature is below a predetermined value (45° C. for example), an automatic non-condensible matter purge operation is carried out. In this embodiment the purge operation is effected by pumping excess coolant into the system for a predetermined period of time. As the system should be essentially full before the initiation of this operation, the excess coolant thus introduced, positively displaces any air or the like the might have collected over a period of time out through the purge port 166.

In this embodiment the purge operation is carried out by energizing valves 152, 134 and 170 and energizing the pump for several tens of seconds. More specifically, valve 152 is conditioned to assume a closed condition, valve 170 an open one and valve 136 conditioned to establish communication between the reservoir 146 and the coolant jacket 120. Thus, pump inducts coolant from the reservoir 146 via conduit 149 and forces same into the coolant jacket through conduit 132. The excess coolant thus introduced accordingly escapes from the top of the system via purge port 166 and overflow conduit 169 and is returned to the reservoir 146. Any air or like non-condensible matter is carried out of the system along with the overflowing coolant.

Upon termination of this mode of operation the system enters a so called "excess coolant displacement/-warm-up mode" wherein the coolant is permitted to heat, produce vapor pressure and displace itself out of the system back to the reservoir via conduit 150. In order to achieve this, only valve 152 is energized to assume an open state while valves 170 and 134 are de-energized to respectively assume a closed position and one in which the coolant jacket 120 is placed in fluid communication with the lower tank 128.

As the coolant is displaced out of the system, the level of liquid coolant falls below that of level sensor 140. Accordingly, pump 136 is energized and coolant is pumped from the radiator 126 into the coolant jacket so as to maintain the level of coolant therein at that of level sensor 140. Accordingly, as coolant is simultaneously being displaced from the system via conduit 150, the radiator and second vapor conduit are emptied of coolant.

It will be noted that as the system is initially filled with coolant, as the coolant is not circulated as in conventional type circulation systems, very little heat can be removed from the engine whereby the coolant and the engine rapidly warm-up and quickly produces the necessary vapor pressure to carry out the above discussed "displacement" mode of operation. During normal operation the vapor produced in the coolant jacket 120 is condensed in the radiator. The rate at which the vapor is condensed is controlled in accordance with the engine load and rotational speed as mentioned earlier.

When the engine is stopped, due to a "thermal inertia" phenomenon, caused by the heat capacity of the cylinder head, cylinder block etc., the coolant will inevitably continue to boil for a short period. This tends to generate a slightly superatmospheric pressure within the system. Accordingly, it is deemed necessary to allow the coolant temperature to drop to a level whereat a slightly sub-atmospheric pressure prevails before permitting the system to assume an open state so as to obviate the tendency for large quantities of coolant be displaced out of the system and to ensure that upon the system being placed in an open condition that the coolant stored in the reservoir will be smoothly inducted to completely fill the system. That is to say, as the vapor condenses the coolant from the reservoir will inducted in a manner to replace same and hence completely fill the system.

This eliminates the tendancy for any atmospheric air to seek its way into the system due to the presence of a sub-atmospheric pressure. If the engine is restarted before the temperature of the coolant has lowered to any notable degree (for example 45° C.), the system immediately undergoes a "warm start" wherein the purge operation is by-passed and the coolant displaced mode directly entered.

What is claimed is:

1. In an internal combustion engine:

a structure subject to high heat flux; and a cooling system comprising:

(a) a cooling circuit which includes:

a coolant jacket formed about said structure subject to high heat flux and into which coolant is introduced in liquid form, permitted to boil and discharged in gaseous form, a radiator exposed to a cooling medium which can remove heat from said radiator, a vapor transfer conduit leading from said coolant jacket to said radiator for transferring gaseous coolant from said coolant jacket to said radiator for condensation therein, and means for returning coolant condensed to its liquid form in said radiator to said coolant jacket in a manner to maintain said structure immersed in a predetermined depth of liquid coolant, said coolant returning means taking the form of:

a coolant return conduit which leads from a lower portion of said radiator to said coolant jacket;

a pump disposed in said coolant return conduit, a first level sensor disposed in said coolant jacket, said first level sensor being arranged to control said pump in a manner to maintain said structure immersed in said predetermined depth of liquid coolant, and means defining a port in an upper portion of said cooling circuit, said port being closed by a manually removable member;

(b) a reservoir containing liquid coolant;

(c) valve and conduit means for controlling fluid communication between said reservoir and said cooling circuit, said valve and conduit means including:

a first valve disposed in said coolant return conduit between said radiator and said pump, and a first conduit which leads from said reservoir to said first valve, said first valve having a first state wherein communication between said pump and said radiator is established and a second state wherein communication between said pump and said reservoir is established;

(d) a two position valve disposed in said coolant return conduit at a position between said pump and said coolant jacket; and (e) a by-pass conduit leading from said coolant return conduit to said lower portion of said radiator, said two position valve having a first position wherein said pump is communicated with said coolant jacket and a second position wherein said pump is communicated with said lower portion of said radiator.

2. An internal combustion engine as claimed in claim 1, wherein said valve and conduit means further comprises a second conduit which leads from said reservoir to a lower potion of said coolant jacket;

a second valve disposed in said second conduit, said second valve having a first state wherein communication between said reservoir and said coolant jacket is permitted and a second state wherein the commuication is interrupted;

a third conduit leading from said reservoir to an upper section of said cooling circuit; and a third valve disposed in said third conduit said third valve having a first state wherein communication between said reservoir and said coolant jacket is permitted and a second state wherein the commuication is interrupted.

3. An internal combustion engine as claimed in claim 1, further comprising:

a first parameter sensor for sensing a parameter which varies with the temperature of the coolant in said coolant jacket;

a second parameter sensor for sensing a parameter which varies with load on said engine;

a device associated with said radiator for varying the rate of heat exchange between the cooling medium and said radiator;

a control circuit responsive to the ouputs of said first and second sensors for controlling the operation of said device in manner to maintain the temperature of said coolant at a desired level.

4. An internal combustion engine as claimed in claim 2, further comprising a manually operable switch which when closed supplies electrical energy to said pump and said first and second valves in manner to induce said first and second valves to assume their respective second states.

5. An internal combustion engine as claimed in claim 3, wherein said valve and conduit means further comprises:

a second level sensor, said second level sensor being disposed in a small collection tank at the bottom of said radiator, and a control circuit which is responsive to the outputs of said first level sensor, said second level sensor, said first parameter sensor and said second parameter sensor, said control circuit controlling the operation of said device said pump and said first second and third valves.

* * * * *